US005899274A

United States Patent [19]

Frauenfeld et al.

[11] Patent Number: 5,899,274

[45] Date of Patent: May 4, 1999

[54] SOLVENT-ASSISTED METHOD FOR MOBILIZING VISCOUS HEAVY OIL

[75] Inventors: Theodore J. W. Frauenfeld; Douglas A. Lillico, both of Edmonton, Canada

[73] Assignee: Alberta Oil Sands Technology and Research Authority, Alberta, Canada

[21] Appl. No.: 08/717,476

[22] Filed: Sep. 20, 1996

[51] Int. Cl.[6] ..... E21B 43/16

[52] U.S. Cl. ..... 166/401; 166/305.1

[58] Field of Search ..... 166/305.1, 401, 166/403

[56] References Cited

U.S. PATENT DOCUMENTS

| | | | |
|---|---|---|---|
| Re. 24,873 | 9/1960 | Lindauer, Jr. | 166/268 |
| 2,822,872 | 2/1958 | Rzasa et al. | 166/401 |
| 3,080,917 | 3/1963 | Walker | 166/401 |
| 3,203,481 | 8/1965 | Dew et al. | 166/401 |
| 3,354,953 | 11/1967 | Morse | 166/401 X |
| 3,856,086 | 12/1974 | Braden, Jr. | 166/403 |
| 3,954,141 | 5/1976 | Allen et al. | 166/403 |
| 4,022,278 | 5/1977 | Allen | 166/401 X |
| 4,086,961 | 5/1978 | Braden, Jr. et al. | 166/401 X |
| 4,299,286 | 11/1981 | Alston | 166/403 |
| 4,344,485 | 8/1982 | Butler | 166/271 |
| 4,589,486 | 5/1986 | Brown et al. | 166/252.1 |
| 5,232,049 | 8/1993 | Christiansen et al. | 166/401 X |

OTHER PUBLICATIONS

Paper No. 95–118, Petroleum Society of CIM, "Extraction of Heavy Oil and Bitumen Using Solvents at Reservoir Pressure", S. K. Das et al, University of Calgary, Oct. 16–18, 1995.

Paper No. 7, Petroleum Society of CIM and CANMET, "Recovery of Heavy Oils Using Vaporized Hydrocarbon Solvents: Further Development of The Vapex Process", R. M. Butler et al, University of Calgary, Oct. 7 –9, 1991.

*Primary Examiner*—David J. Bagnell
*Attorney, Agent, or Firm*—Sheridan Ross P.C.

[57] ABSTRACT

The invention provides a solvent-assisted method for mobilizing viscous heavy oil or bitumen in a reservoir under reservoir conditions without the need to adjust the temperature or pressure. The invention utilizes mixtures of hydrocarbon solvents such as ethane, propane and butane, which dissolve in oil and reduce its viscosity. Two or more solvents are mixed in such proportions that the dew point of the solvent mixture corresponds with reservoir temperature and pressure conditions. The solvent mixture, when injected into a reservoir, exists predominantly in the vapor phase, minimizing the solvent requirement. The invention can be practised in the context of paired injector and producer wells, or a single well cyclic system.

8 Claims, 11 Drawing Sheets

METHANE / PROPANE COMPOSITION DIAGRAM
(Lean Mix at 15.5° C)

FLUID PARTITIONING AT RESERVOIR CONDITIONS
(3.545 MPa, 15.5 °C)

$CO_2$ ASSISTED GRAVITY DRAINAGE, BURNT LAKE
Cumulative Oil and Rate vs. Time

LEAN MIX GRAVITY DRAINAGE, BURNT LAKE
Cumulative Oil and Rate vs. Time

RICH MIX GRAVITY DRAINAGE, BURNT LAKE
Cumulative Oil and Rate vs. Time

RICH MIX+ GRAVITY DRAINAGE, BURNT LAKE
Cumulative Oil and Rate vs. Time

SOLVENT-ASSISTED METHOD FOR MOBILIZING VISCOUS HEAVY OIL

FIELD OF THE INVENTION

The invention relates to a solvent-assisted method for recovering bitumen and heavy oil from a reservoir. In particular, the invention provides oil recovery methods utilizing solvents comprising hydrocarbon mixtures which are effective in mobilizing bitumen and heavy oil under reservoir conditions, without the need to adjust the pressure or temperature.

BACKGROUND OF THE INVENTION

Recovery of heavy oil (herein defined as bitumen and oil with a viscosity of greater than 100 mPa.s) from the extensive tar sand deposits in Alberta, Saskatchewan and other parts of Canada is hampered by its viscosity, which renders it partially or completely immobile under reservoir conditions. For example, the heavy oil in Lloydminster reservoirs has limited mobility, with a viscosity of several thousand mPa.s, whereas the bitumen in the Cold Lake reservoir is almost completely immobile, with a viscosity in the order of 40,000–100,000 mPa.s.

Currently, oil production from viscous deposits which are too deep to be mined from the surface is generally achieved by heating the formation with hot fluids or steam to reduce the viscosity of the heavy oil so that it is mobilized toward production wells. For example, one thermal method, known as "huff and puff", relies on steam injected into a formation through a producer well, which is then temporarily sealed to allow the heat to "soak" and reduce the viscosity of the bitumen in the vicinity of the well. Mobilized bitumen is then produced from the well, along with steam and hot water until production wanes, and the cycle is repeated. Another thermal method, known as steam assisted gravity drainage (SAGD), provides for steam injection and oil production to be carried out through separate wells. The optimal configuration is an injector well which is substantially parallel to, and situated above a producer well, which lies horizontally near the bottom of a formation. Thermal communication between the two wells is established, and as oil is mobilized and produced, a steam chamber or chest develops. Oil at the surface of the enlarging chest is constantly mobilized by contact with steam and drains under the influence of gravity. Under this scheme, production can be carried out continuously, rather than cyclically.

All thermal methods have the limitation that steam and heat are lost to the formation. In reservoirs where the deposits are relatively thin, in the order of 8 meters, loss of heat to overburden and underburden makes thermal recovery particularly uneconomical. Another problem is loss of heat and steam through fractures in the formation, or to underlying aquifers.

Because of the difficulties encountered in attempting to produce tar sands formations with thermal processes, the use of solvents, rather than heat, as a means to mobilize heavy oils has been proposed. Hydrocarbon solvents such as ethane, propane and butane are partially miscible in oil, and when dissolved in oil, reduce its viscosity. A number of references have suggested mixing of solvents to achieve miscibility with heavy petroleum under reservoir conditions.

In a method known as the VAPEX method, hydrocarbon solvents, rather than steam, are used in a process analogous to SAGD, which utilizes paired horizontal wells. An hydrocarbon such as heated propane in vapor form, (or propane in liquid form in conjunction with hot water) is injected into the reservoir through an injector well. Propane vapor condenses on the gas/oil interface, dissolves in the bitumen and decreases its viscosity, causing the bitumen-oil mixture to drain down to the producer well. The propane vapors form a chest, analogous to the steam chest of SAGD.

The pressure and temperature conditions in the reservoir must be such that the propane is primarily in vapor, rather than liquid form so that a vapor chest will develop. Ideally, the conditions in the reservoir should be just below the vapor liquid line. A serious drawback of the VAPEX method is that temperature and pressure conditions in a reservoir are seldom at the dew point of known solvents. Therefore, it is necessary to adjust the pressure and/or temperature in the system to create reservoir conditions under which the particular solvent is effective. However, this is not feasible in all reservoirs. Increasing the pressure could lead to fluid loss into thief zones. Reducing the pressure could cause an influx of water.

A recently described process called "Butex" relies on the use of an inert "carrier gas" such as nitrogen to vaporize a hydrocarbon solvent such as butane or propane in the reservoir.

In order to make the use of hydrocarbon solvents to reduce oil viscosity generally feasible and economical under field conditions, there is a need for solvents which:

- are predominantly in the vapor phase at reservoir conditions, and can be used without the need to adjust the pressure or temperature conditions in the reservoir;
- have high solubility in reservoir oil at reservoir conditions; and
- are readily obtainable at reasonable cost.

SUMMARY OF THE INVENTION

In accordance with the present invention, a method is provided for mobilizing heavy oil comprising tailoring the composition of a partially miscible solvent mixture to reservoir pressure and temperature conditions. Two or more solvents are mixed in such proportions that the dew point of the mixture is near the reservoir temperature and pressure, so that the solvent will exist predominantly in the vapor phase in the reservoir, without the need for heat input or pressure adjustment. The invention can be practised either in the context of paired injector and producer wells, or a single well cyclic system. The solvent mixture is injected through horizontal or vertical injector wells, or through the horizontal producer well for a cyclic operation, into a subterranean formation containing viscous oil. The solvent dissolves in the viscous oil at the oil/solvent interface. The solubility of the solvent in the reservoir oil at reservoir conditions is preferably at least 10 weight percent. The viscosity of the oil/solvent mixture is reduced several hundred fold from the viscosity of the oil alone, thus facilitating the drainage of the oil to a horizontal producer well situated near the bottom of the formation. Preferably, the viscosity of the oil/solvent mixture is 100 mPa.s. or less.

The solvent mixtures of the invention are designed using the strategy outlined below. Solvent mixtures, in contrast to single component solvents, are adaptable to a wide and continuous range of reservoir conditions because of their phase behaviour. The phase diagram (plotted as pressure versus temperature) of a single component solvent, such as ethane, exhibits a discrete vapor/liquid line. However, the phase diagram of a solvent comprising two or more components, such as a mix of methane, ethane and propane, forms an "envelope" rather than a line. Therefore, a range of conditions exists under which the mixture will be in two phases, rather than a single phase. In addition, it is possible to adjust the proportion of the components of the mixture, so that the phase envelope will encompass the reservoir temperature and pressure conditions. Therefore if the pressure and temperature conditions within a reservoir are known, the following criteria can be used to select the components and the proportions of each component in the solvent mixtures.

1. The mixture should exist partially, preferably predominantly, in the vapor phase at reservoir conditions, in order to fill the chest cavity and minimize solvent inventory, but some liquid is desirable because liquid is more aggressive as a solvent than vapor.
2. The mixture should have a high solubility in the reservoir oil, preferably being capable of dissolving at least 10 weight percent in the reservoir oil at reservoir conditions.
3. The resultant oil/solvent mixture should have a low viscosity, preferably below 100 mPa.s for efficient gravity drainage.

Calculations to determine phase behaviour and solubility in the reservoir oil are performed using the Peng-Robinson equation of state. Generally, the lighter hydrocarbons (Cl through C3) are the most useful in achieving a mixture which is primarily on the vapor rather than the liquid state under the conditions found in heavy petroleum deposits. However, longer chain hydrocarbons can be mixed in as long as the vapor/liquid envelope of the mixture encompasses reservoir conditions. The viscosity of the oil/solvent mixtures can be calculated using the Puttagunta correlation (Puttagunta, V. R. Singh, B. and Cooper, E.: A generalized viscosity correlation for Alberta heavy oils and bitumens. Proceedings 4th UNITAR/UNDP conference on Heavy Crudes and Tar Sands No. 2: 657–659 1988.) Mixtures which have the desired phase behaviour and produce an oil/solvent mixture of low viscosity are thus identified.

Figure 9:
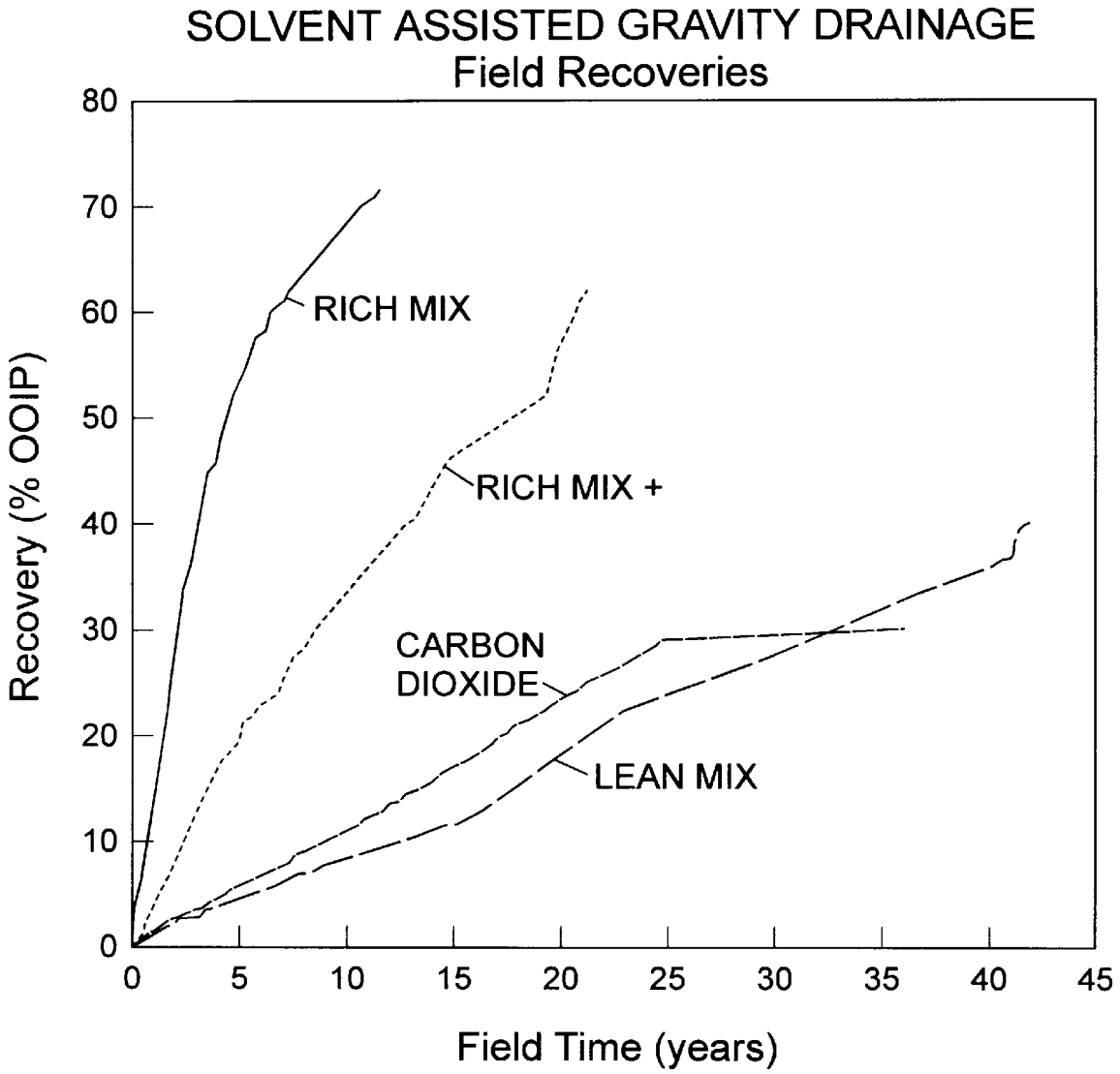

Panel A: pure $CO_2$;

Panel B: a mixture of methane and propane ($CH_4$:$C_3H_8$, 70:30), called "lean mix";

Panel C: a mixture of methane and propane ($CH_4$:$C_3H_8$, 30:70), called "rich mix"; and Panel D: a mixture of methane, ethane and propane ($CH_4$:$C_2H_6$: $C_3H_6$, 18:70:12), called "rich mix +"; and FIG. 9 is a graphic depiction of the projected field recoveries (%OOIP) over time for the solvents from FIG. 8.

DETAILED DESCRIPTION OF THE INVENTION

Figure 1:
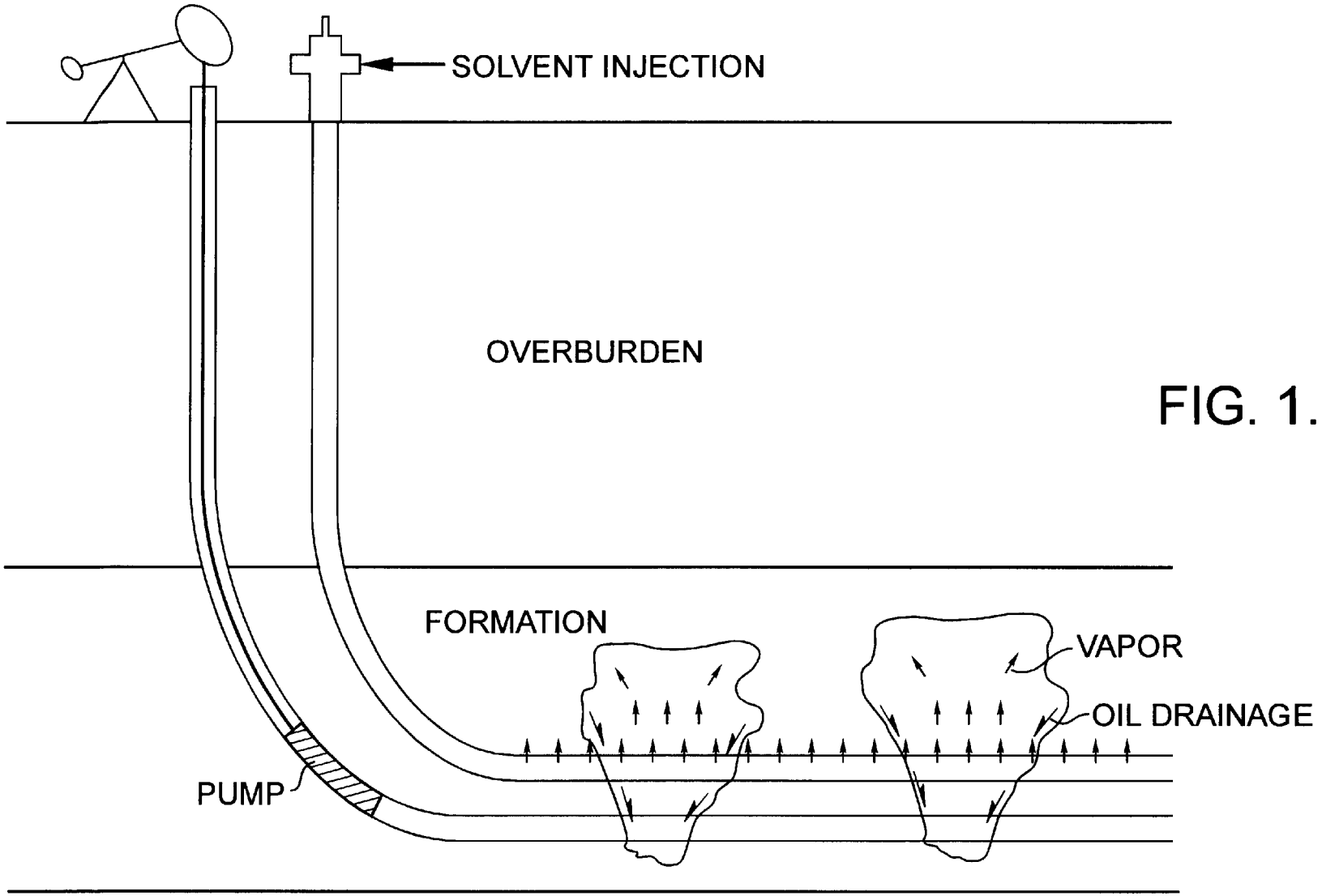
FIG. 1 is a schematic drawing illustrating a hypothetical field implementation of the invention, showing paired horizontal injector and producer wells completed in a heavy oil formation, and indicating two established vapor chests along the length of the wells.

The use of solvent mixtures to mobilize heavy oil in conjunction with oil recovery by gravity drainage can be practised in a number of types of well configurations. FIG. 1 shows a schematic representation of an exemplary configuration, having pairs of wells which extend through the formation, close to its base, in a substantially horizontal and parallel arrangement, with one well, the "injector", lying above the other well, the "producer". Alternatively, the pair of horizontal wells could be staggered in the formation, rather than placed in the same vertical plane. In another possible embodiment, injector wells could comprise a series of substantially vertically wells, situated above a horizontal producer. The invention can also be used in conjunction with a single well cyclic system, where injections of solvent through a horizontal producer are alternated with production of the mobilized oil. The invention can be used for both primary and post-primary production, in both dual and single well systems. If a primary process is operated using a single horizontal well, the drilling of a second well for a dual well solvent assisted process could be delayed until after the completion of primary production if it were economically advantageous to do so.

In any of these configurations, the injected solvent mixture will dissolve in the heavy petroleum in the vicinity of the injector well, with the solvent/oil mixture having greatly reduced viscosity. Mobilized oil drains to the producer well. In a dual well configuration such as that depicted in FIG. 1, communication between the injector and producer wells can be accelerated by applying a pressure gradient from the upper to the lower well. However, if the oil has some initial mobility, this may not be necessary. In post-primary production, breakthrough channels will already exist. Ultimately a series of vapor-filled cavities, called "chests", develop from which the heavy oil has been stripped, but the sand matrix remains. Oil is then continually mobilized from the oil/solvent interface in the chest. The initiation of gravity drainage chest formation along the entire length of a horizontal well is important in avoiding short circuiting of the injected fluids. In reservoirs with highly immobile oil, breakthrough will be easier to achieve if the wells are above each other and closely spaced. However, the size of the chest will be maximized if the wells are farther apart, and staggered, rather than one above the other in the formation.

The design of a solvent to suit conditions in each reservoir to be produced is central to the invention. Under reservoir conditions, the solvent must have a sufficient vapor phase component so that the chest cavity remains filled with vapor. However, the solvent should have some liquid phase component at reservoir conditions, because the liquid phase is a more aggressive solvent. In a preferred embodiment, the solvent is injected as a gas. Because the dew point of the solvent substantially corresponds with reservoir temperature and pressure conditions, as the solvent reaches these conditions, either in the tubing as it approaches the reservoir or in the reservoir itself, a portion of the solvent goes into the liquid phase, producing a 2 phase solvent. The gas phase solvent fills the chest cavity, dissolving in the oil at the oil/gas interface. The liquid phase solvent flows down onto the lower portion of the chest cavity by virtue of gravity, and there acts as a very aggressive solvent, dissolving in, and mobilizing the oil. Ideally, the solvent mixture should have a solubility in reservoir oil at reservoir conditions of at least 10 percent by weight. Although liquid solvent is highly effective, for economic reasons it is desirable to keep the liquid phase component small, in order to minimize solvent inventory.

Mixtures of solvents can be tailored to a wide and continuous range of reservoir conditions because of their phase behaviour. A phase diagram of a single component solvent exhibits a discrete vapor/liquid line, exemplified by the phase diagram for $CO_2$ shown in FIG. 3. If reservoir conditions are close to the dew point of a solvent, that solvent can be used under reservoir conditions. However, if reservoir conditions do not lie near the vapor/liquid line for that solvent, it is necessary to adjust the temperature and/or pressure so that the solvent will be in the vapor phase.

With solvents comprising two or more components, such as mixtures of methane, ethane and propane, the phase diagram comprises a vapor/liquid envelope, rather than a line. Such an envelope is exemplified by the 2 phase area identified in FIG. 4. The use of such solvents therefore provides the means to sensitively adjust the phase behaviour of the injected solvent so that it is optimal under reservoir conditions. Firstly, it is possible to choose components for the solvent mixture, and to adjust the proportion of those components, such as $CO_2$, methane, ethane and propane, so that the phase envelope will encompass the reservoir temperature and pressure conditions. Secondly, a range of conditions will exist under which the mixture will be in two phases, rather than a single phase, so that the proportion of the solvent which will exist as vapor and liquid can also be controlled.

To summarize, once the pressure and temperature conditions within a reservoir are known, the following criteria are used to select the components and the proportions of each component of the solvent mixtures with respect to those conditions:

1. The solvent mixture should exist predominantly in the vapor phase, in order to fill the chest and minimize solvent inventory, but some liquid is required because liquid is more aggressive as a solvent,
2. The mixture should have a high solubility in the reservoir oil, preferably at least 10 percent by weight, and
3. The resultant oil-solvent mixture should have a low viscosity, preferably below 100 mPa.s.

Calculations to determine phase behaviour and solubility in the reservoir oil are performed using the Peng-Robinson equation of state. A computer program which will conveniently handle these calculations is the "Peng-Robinson PVT Package" available from D.B. Robinson and Associates, Edmonton , Alberta. In general, lighter hydrocarbons (Cl through C3) are most useful in achieving a mixture which is primarily in the vapor rather than the liquid state under the conditions found in heavy petroleum deposits. However, longer chain hydrocarbons can be mixed in as long as the vapor/liquid envelope of the mixture encompasses reservoir conditions. Because cost of solvent components is crucial in making oil recovery economical, it is generally advantageous to maximize the use of low cost solvents, such as ethane and add smaller amounts of higher cost solvents to tailor the mixture.

The viscosity of the oil/solvent mixtures at reservoir conditions can be calculated using the Puttagunta correlation ( Puttagunta et al., 1988, cited above). Under conditions such as those found in the Burnt Lake reservoir, for example, the calculations show that the viscosity of reservoir bitumen (approximately 18,000 mPa.s) can be reduced several hundred fold, to 400–35 mPa.s, depending on the solvent used. Solvents which meet both (1) the required phase behaviour characteristics, and (2) which are predicted to form a low-viscosity solution with oil are selected. Ideally, the viscosity of the solvent/oil mix should be below 100 mPa.s.

The process of fine tuning solvent composition can be illustrated by examining sample calculations for the design of the "rich mix +" solvent used in Example 4 below. Phase behaviour calculations, done using the Peng-Robinson equation, indicated that a solvent mix containing methane, ethane and propane at a ratio of 15:70:15, would exist as 36.6 mole percent liquid under reservoir conditions, whereas the "rich mix +" solvent mixture containing the same components in a slightly different ratio, 18:70:12 would exist as 14.0 mole percent liquid under reservoir conditions. It was also determined that the 15:70:15 mix would exist as 15 mole percent liquid at surface conditions (20°C., and 3.445 mPa), whereas the "rich mix +" solvent would exist entirely as vapor under the same conditions. Thus the 18:70:12 mixture would minimize solvent inventory in the reservoir. Another practical reason for selecting the "rich mix +" over the 15:70:15 mix was that it could be injected as a single phase (gas) mixture at surface conditions.

Other considerations to be applied in the selection of a solvent mixture are as follows.

1. Both the vapor and liquid phases should have substantial solubility in the oil.
2. The concentration of a particular solvent component (such as propane) which tends to cause excessive precipitation of asphaltenes, which can block drainage to the production well, should be minimized.
   However, some asphaltene precipitation causes an upgrading of oil, as well as a decrease in its viscosity, and may be desirable.
3. Solvent components should have a high vapor pressure in order to maximize solvent recovery.
4. Solvent components should be as inexpensive as possible.
5. Minimum bypassing of solvent is achieved when the solvent phase dissolves substantially completely in the oil, rather than having the oil strip the rich components from the mixture. Maximum solubilization is best accomplished by having a "predominant" solvent component, with smaller amounts of other components added in for purposes of tailoring.

Laboratory experiments to test the efficacy of the present invention in mobilizing heavy oil were carried out using partially scaled physical models. Using these models, the invention was tested in the context of a process involving paired injector and producer wells. The experiments modeled the conditions existing in a bitumen deposit typical of the Burnt Lake reservoir.

Experimental set-up

Figure 2:
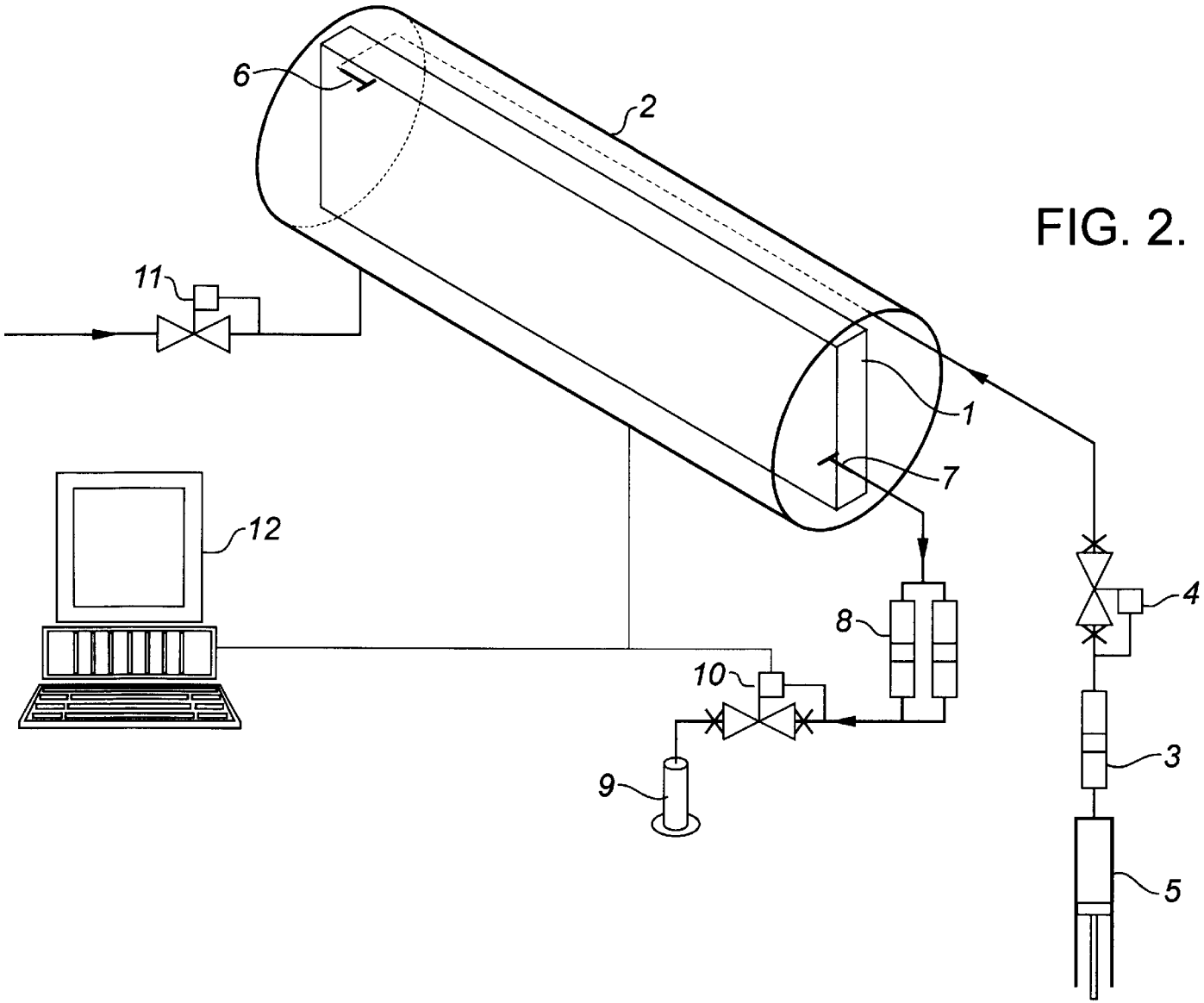
FIG. 2 is a schematic drawing of the laboratory apparatus used in carrying out partially scaled physical model experiments.

The experimental apparatus is illustrated schematically in FIG. 2. A sand-packed experimental cell 1, made of thin-walled stainless steel (316 SS) was housed in a pressure vessel 2. During an experimental operation, the solvent, in liquid phase, was displaced from the injection accumulator 3 through the injection back pressure regulator 4 by means of a positive displacement pump 5. The solvent was flashed to a vapor, and the vapor was injected into the experiment cell through an injector well 6. Produced oil and solvent were produced through the producer well 7, and collected under pressure in the production accumulators 8, which were emptied into a production volume measuring device 9. The production back pressure regulator 10 regulated a flow of water from the production accumulators such that the test cell was maintained at a constant pressure during the experiment. The system was supplied with a gas overburden pressure through a regulator 11 to confine the experimental cell. A computer and data logger 12 monitored injection, production and overburden pressure transmitters, differential pressure transmitter, produced oil viscometer, and thermocouples.

The experimental sand-packed cell was designed to represent a 2-dimensional slice through a reservoir. The internal dimensions of the cell varied from experiment to experiment, and were designed to model a specific reservoir thickness, and a specific spacing and configuration of wells. The internal dimensions varied from 15–30 cm inside height, 5 cm inside depth, and 30–60 cm inside width. During an experimental run, the cell was packed with sand, and then filled with oil and brine to simulate field conditions in accordance with the partially scaled model. The producer well had an internal diameter of 0.635 cm, with walls permeated by 1.5×5.0 cm slots. The injector well had an internal diameter of 0.635 cm, with walls permeated with round holes of diameter of 0.25 cm. Saturation wells (not shown in FIG. 2) were situated horizontally at the top and bottom of the cell through which oil and brine, respectively, were introduced. All wells were made from 316 SS and covered with 60 mesh screen.

Scaling

The field process was scaled to the laboratory model using #1 of the 5 sets of scaling criteria described by Kimber (Kimber, K.: High pressure scaled model design techniques for thermal recovery processes. (PhD. dissertation, Department of Mining, Mineral and Petroleum Engineering, University of Alberta, 1989), which is also known as the Pujol and Boberg Criteria. This set of criteria correctly scales ratios of gravity to viscous forces, and correctly scales heat transfer and diffusion. Capillary forces and dispersion are not correctly scaled, but the natural heterogeneity present in the reservoir at field scale enables the coarser sand in the model to approximate the dispersion observed in the finer field sand (Walsh, M. P. and Withjack, E. M.: On some remarkable observations of laboratory dispersion using computed tomography. Jour. Can. Pet. Tech., Nov. 1994 36–44.).

A scaling ratio of 50:1 (field:model) was selected to translate the scaling criteria into a useful experimental design. In order to simulate Burnt Lake Reservoir conditions, a hypothetical heavy oil reservoir with a net thickness of 15 meters was represented by a height of 30 cm in the model. The permeability of the sand was scaled up by a factor of 50, so that a field permeability of 2.8 Darcy was scaled up to a model permeability of 140 Darcy, which was achieved by using 20–40 mesh sand. Time was compressed by a factor of $50^2$:1, or 2500:1, so that 3.5 hours of elapsed time in the laboratory represented 1 year of field time. In order to scale gravitational versus viscous forces, the mobility in the model must be 50 times greater than the mobility in the field, which was achieved by using graded Ottawa sand packs and field oil blends to obtain model mobilities in the correct range. The model was operated at reservoir pressure and temperature, so that oil properties, gas solubilities and oil viscosity ratios were similar in the lab model and the field. The solvent injection rates and oil productions rates were also scaled to the field, the rate scaling factor being 1:50 from model to field.

Table 1 shows a summary of field and model properties for the Burnt Lake reservoir.

TABLE 1

| |
|---|
| Burnt Lake reservoir properties: |
| Oil Viscosity - 40,000 mPa · s (live) |
| Reservoir pressure - 3.45 Mpa |
| Reservoir temperature - 15.5° C. |
| Reservoir permeability - 5 Darcy |
| Reservoir pay thickness - 15 m good, plus 10 m medium |
| Scaled Physical Model properties: |
| 50:1 geometric scaling |
| Oil viscosity - 18,000 mPa · s (dead oil) |
| Model pressure - 3.45 mPa |
| Model temperature - 15.5° C. |
| Model permeability - 140 Darcy |
| Model thickness - 30 cm |
| Model pordsity - 32% |
| Model saturations: 14% water, 86% oil |

Experimental procedure

The cell was prepared according to the well configuration chosen. For the $CO_2$ and "lean mix" experiments, the injector well was placed vertically above the producer. In the "rich mix" and "rich mix +" experiments, the injector well was above the producer and offset horizontally to produce a "staggered well" configuration, as depicted in FIG. 2. The cell was packed with sand of the desired permeability, welded shut and tested for leaks.

The cell was placed in the pressure vessel and the injection, production and pressure port tubing was connected. Overburden pressure was applied to the cell by filling the pressure vessel with nitrogen gas. The experiments were conducted at reservoir temperature, 15.5° C. The cell temperature was maintained by means of a refrigeration unit.

In order to simulate the oil and brine found in field reservoirs, the cell was first saturated with a synthetic reservoir brine by injection of brine through a bottom saturation well, and production of air and brine from a top saturation well. Reservoir oil of viscosity 22,000 mPa.s (to simulate Burnt Lake reservoir oil) was then injected from the top saturation well, and brine and oil was produced from the bottom saturation well. The volumes of oil and brine injected and produced were measured in order to calculate the initial oil and water saturations.

For gravity drainage tests, the experiment was run by injection of solvent at a constant rate and production of oil and solvent from the producer well at constant pressure. The GOR (gas/oil ratio) of the produced oil was monitored during the experiment. If the GOR was in excess of 100 std. Cc/cc oil, the solvent injection rate was decreased. If the GOR was less than 80 std. Cc/cc, the solvent injection rate was increased. The objective was to maintain a GOR at the GOR which represented an oil fully saturated with solvent at the given reservoir conditions. A higher GOR meant that free gaseous solvent was being produced with the oil, and that the production rate was higher than the rate at which oil was draining to the production well. A lower GOR meant that the oil was not fully saturated with solvent, and that the oil viscosity was higher than optimal. The initial solvent injection rate was 90 cc(liquid) per hour.

Produced oil samples were taken by emptying the production accumulators, initially every 30 minutes, then at less frequent intervals. The oil samples were flashed into collection jars, and the gas released was measured and recorded. The gas volume and oil weight were used to calculate the GOR, which was used to control the solvent injection rate, as described above.

Experiments were continued for 3 days (representing 15 years of field time), or until the oil production rate dropped below a minimum value due to depletion of oil. The cell was then dismantled, the oil sand was sampled, and analyses were performed for oil and water content. The samples were also analyzed for asphaltene content. Production data was processed to yield an oil production profile, and gas injection and production profiles which were scaled to field time.

The experiments examined the efficacy of the following four solvents under Burnt Lake reservoir conditions, which were a temperature of 15.5° C., and a pressure of 3.445 mPa, with oil viscosity of 18,000 mPa.s:

(1) pure $CO_2$;

(2) mixture of methane and propane ($CH_4$:$C_3H_8$, 70:30), called "lean mix";

(3) mixture of methane and propane ($CH_4$:$C_3H_8$, 30:70), called "rich mix"; and (4) mixture of methane, ethane and propane ($CH_4$:$C_2H_6$:$C_3H_6$ ) (18:70:12), called "rich mix +".

The properties of the 4 solvents are shown in Table 2.

TABLE 2

| Mixture | Composition (mole %) Molar | PC (kpa) | Tc (K) | Bubble Pt. (kPa) | Dew Pt. (kpa) | Liq. Dens. (g/cm3) | % Liq. @ 15.5 C. | Oil Visc @ 3.445 mPa (mPa · s) |
|---|---|---|---|---|---|---|---|---|
| CO2 | 100% CO2 | 7375 | 304.2 | 5000 | 5000 | 0.777 | 0 | 406 |
| lean mix | 28% C1–72% C3 | 9992 | 278 | 9738 | 3640 | 0.445 | 0 | 180 |
| rich mix | 30% C1–70% C3 | 6660 | 346 | 5255 | 1090 | 0.451 | 81 | 38 |
| rich mix+ | 18% C1–70% C2–12% C3 | 5976 | 306.2 | 5300 | 3400 | 0.362 | 14 | 37 |

Example 1

Figure 3:
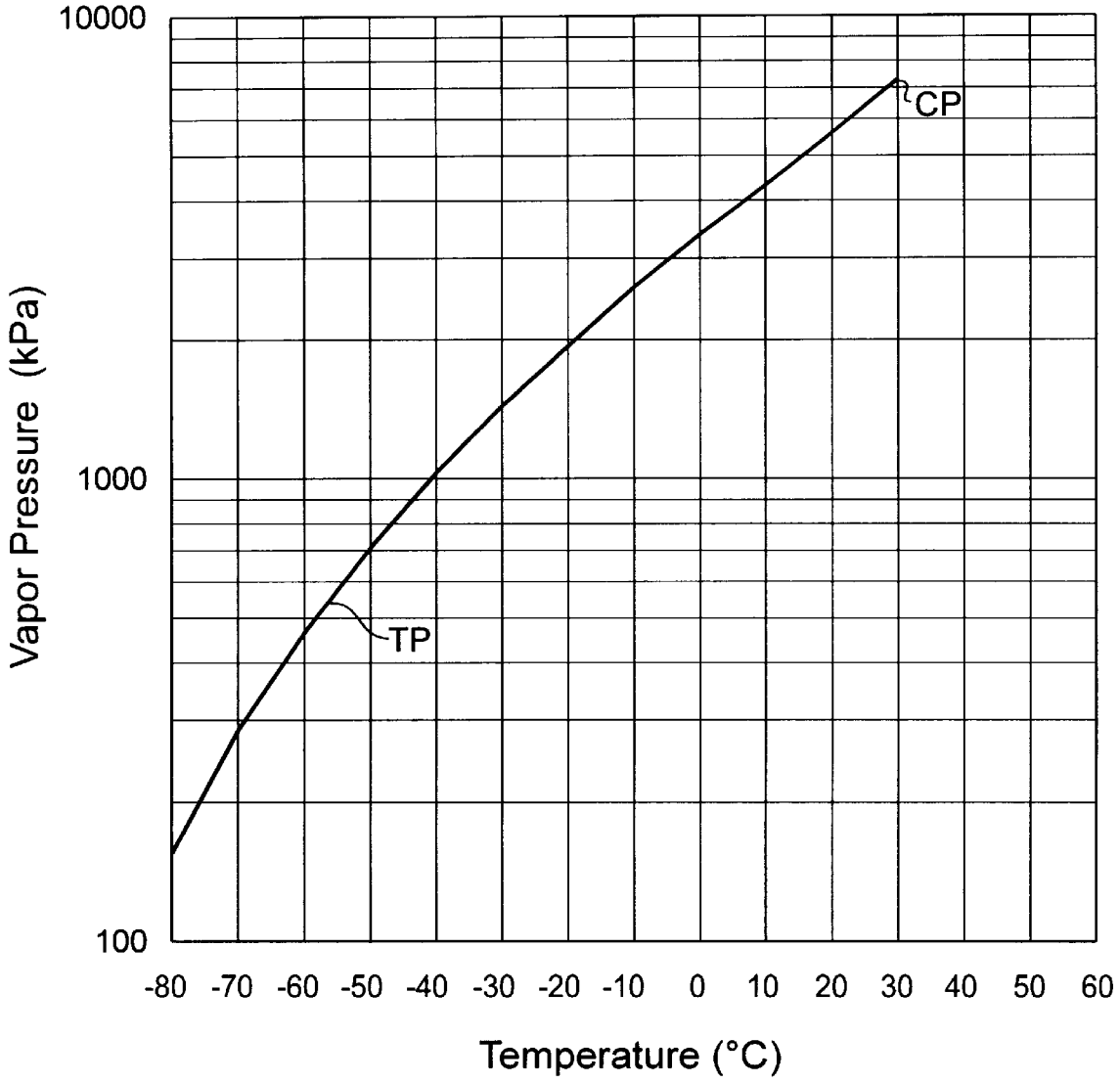
FIG. 3 is a phase diagram for pure $CO_2$.

$CO_2$. A single component solvent, $CO_2$, was tested because the $CO_2$ vapor/liquid line passed close to the reservoir conditions, as shown in FIG. 3. The $CO_2$ therefore existed entirely in the vapor phase at reservoir conditions. It dissolved substantially in the reservoir oil. Application of the Puttagunta correlation indicated that under reservoir conditions, the viscosity of the $CO_2$/oil mixture would be 406 mPa.s, a reduction from the 22,000 mPa.s viscosity of the reservoir oil.

Example 2

Figure 4:
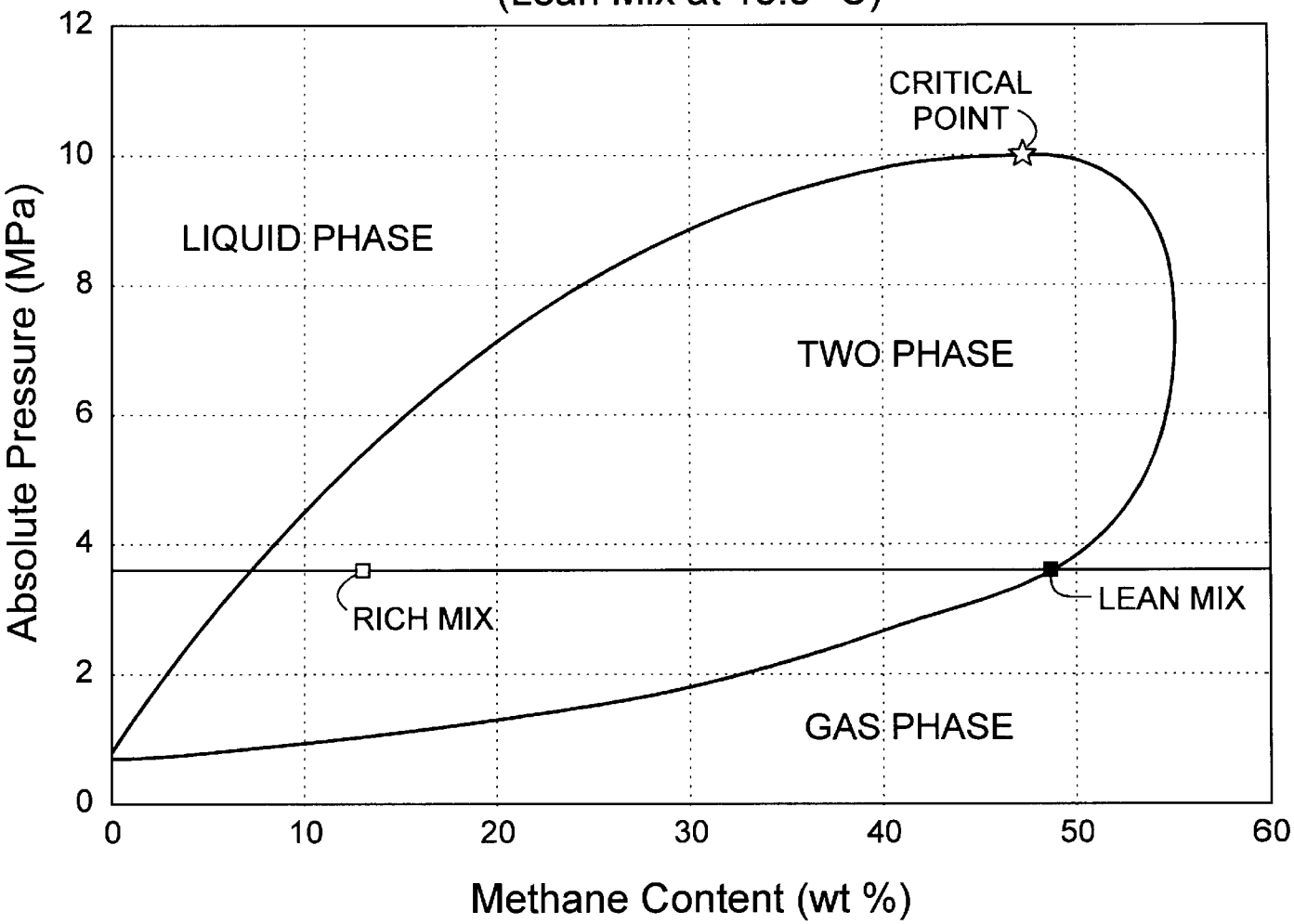
FIG. 4 is a phase diagram for solvent mixtures consisting of methane and propane under Burnt Lake reservoir conditions.
Figure 5:
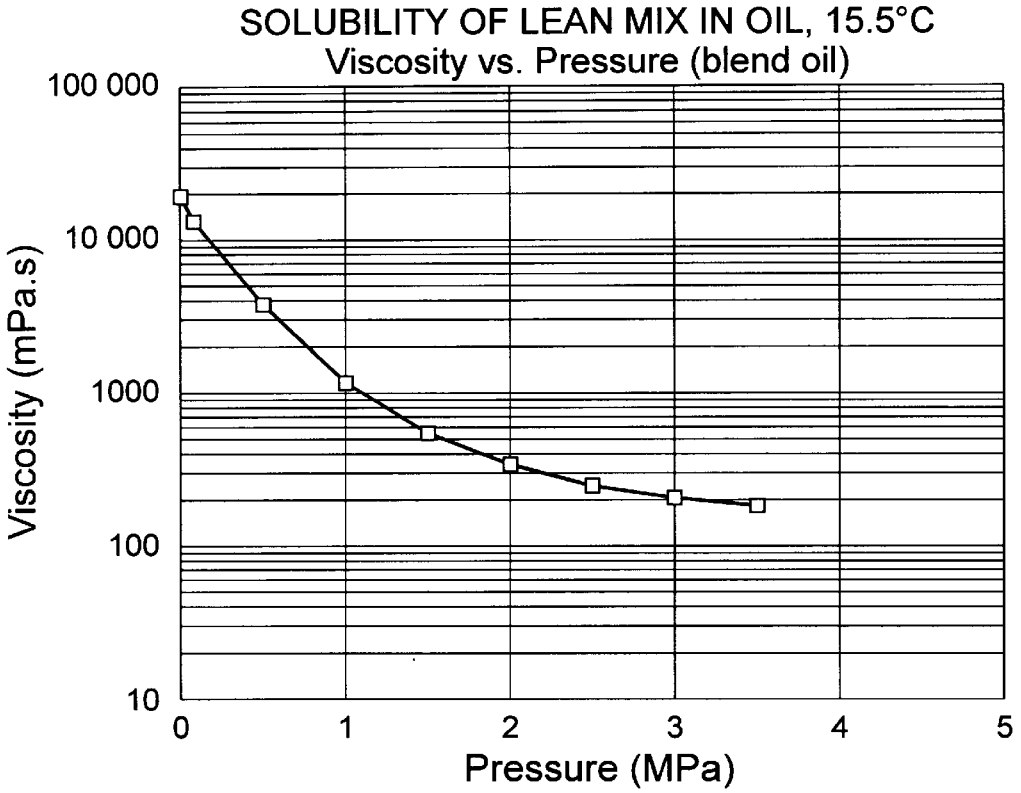
FIG. 5 is a graph showing solubility of a solvent containing methane (70%) and propane (30%) in reservoir oil under Burnt Lake reservoir conditions.

"Lean mix." The proportions of methane and propane in the lean mix (70%:30% on a molar basis) were selected such that the solvent existed entirely as a gas at reservoir conditions, with the dew point of the mixture just above reservoir conditions, as depicted in the phase diagram shown in FIG. 4. The results of a calculation of the solubility of the solvent in oil, and viscosity of the solvent/oil mixture, depicted graphically in FIG. 5, indicated that the viscosity reduction potential was 100-fold, the viscosity of the solvent/oil mixture being 180 mPa.s.

Example 3

Figure 6:
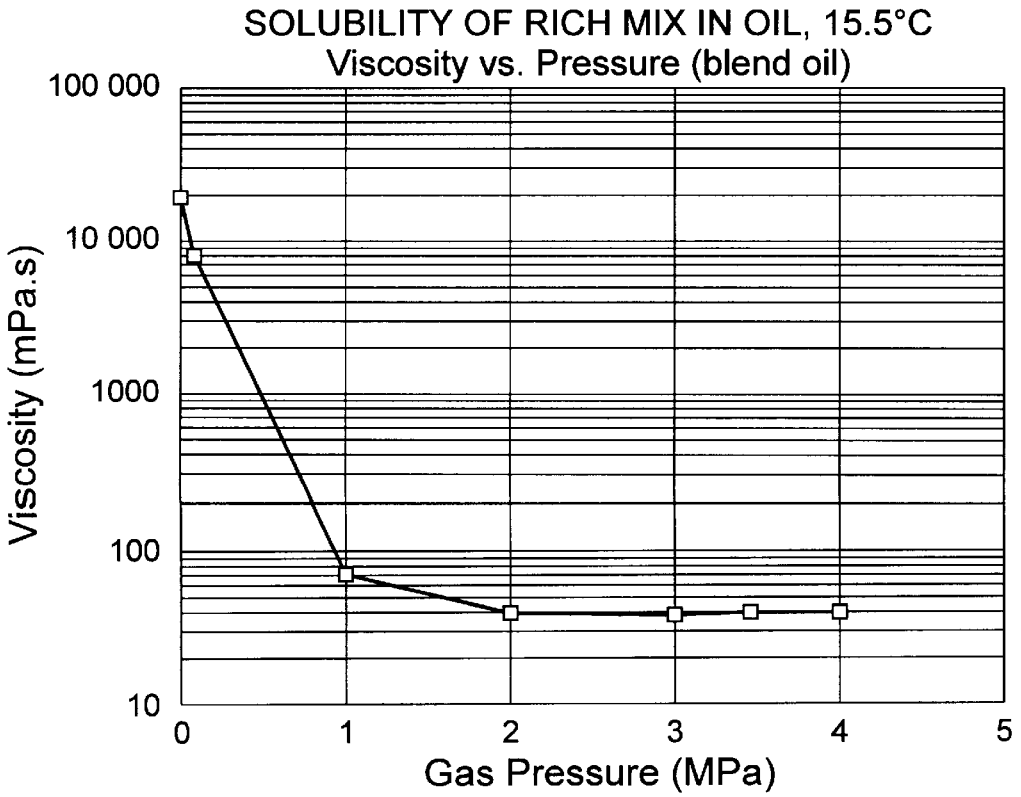
FIG. 6 is a graph showing solubility of a solvent containing methane (30%) and propane (70%) in reservoir oil under Burnt Lake reservoir conditions.

"Rich mix." The proportion of methane and propane in the "rich mix" (30%:70% on a molar basis) resulted in a 2 phase mixture at reservoir conditions, as depicted in the phase diagram shown in FIG. 4. The solvent was predicted to be 81 mole per cent liquid at reservoir conditions. Gas solubility calculations indicated that a propane content of 70% was the richest mix which would sustain a sufficient volume of vapor to replace the volume of produced oil. The results of a calculation of the solubility of the solvent in oil, and viscosity of the solvent-oil mixture, depicted graphically in FIG. 6 indicated that the viscosity reduction potential was approximately 500-fold, down to 38 mPa.s. This solvent also caused precipitation of asphaltenes from the oil, which resulted in an upgraded product.

Example 4

Figure 7:
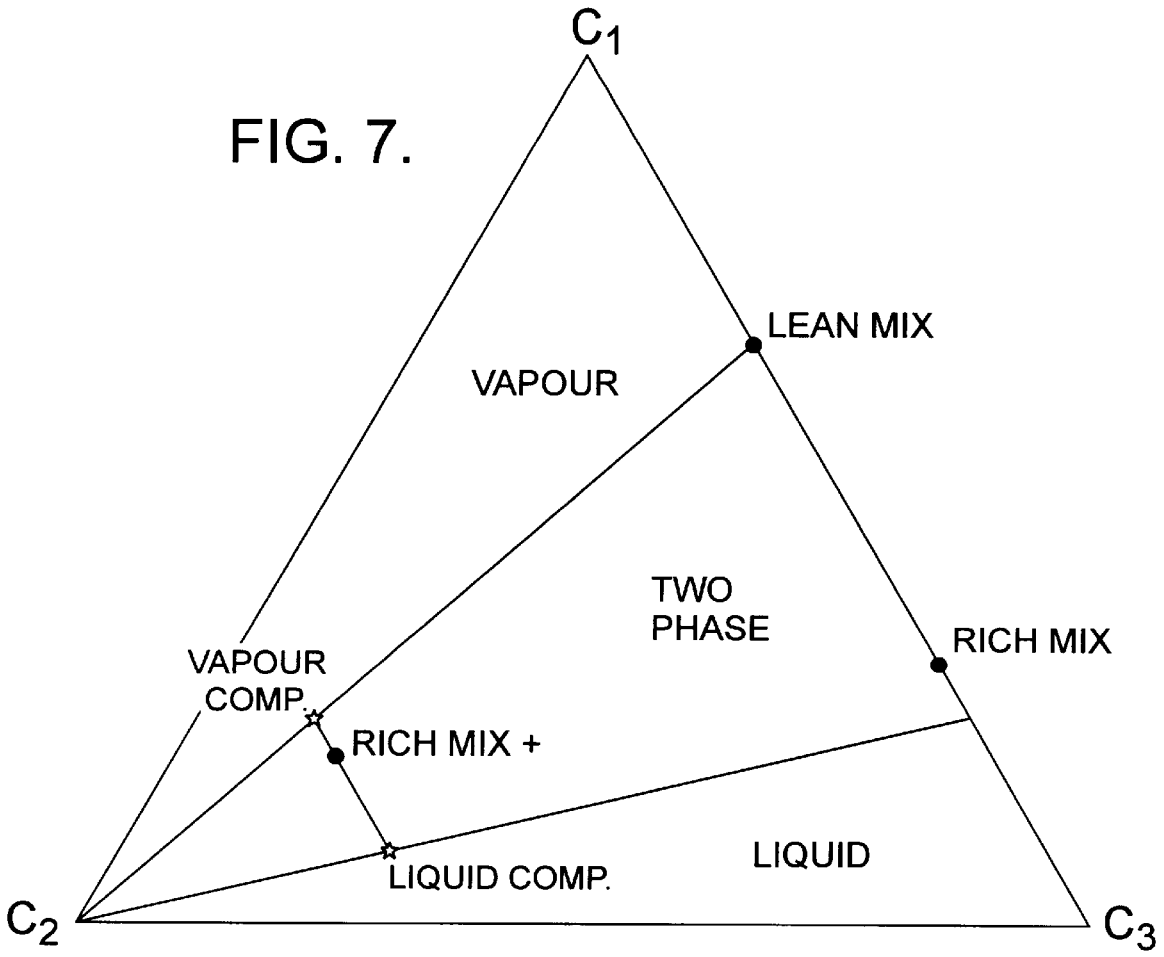
FIG. 7 is a phase diagram showing fluid partitioning at reservoir conditions for solvent mixtures containing methane:propane (70:30), methane:propane (30:70), and methane:ethane:propane (18:70:12)
Figure 8A:
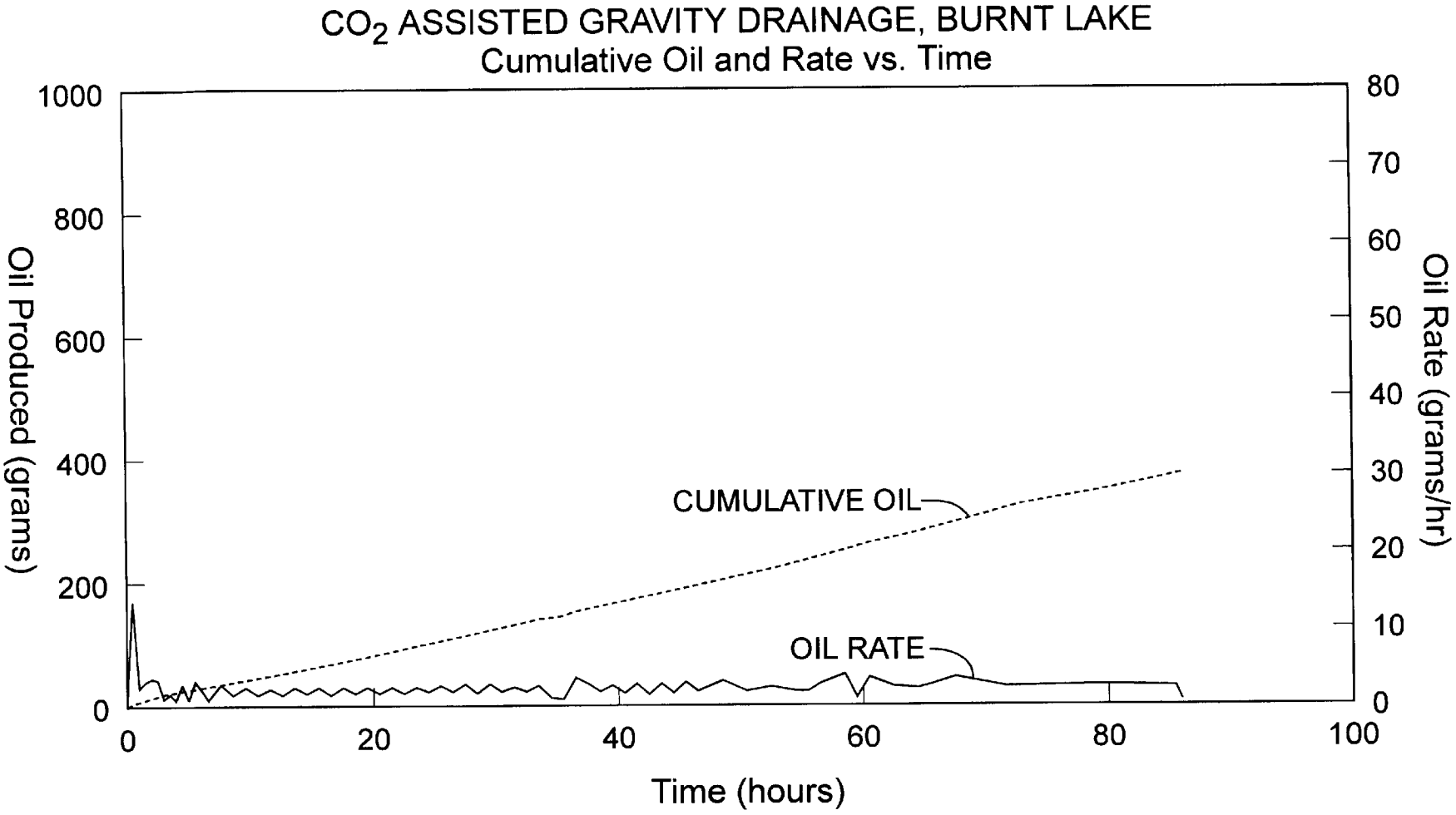
FIG. 8 is a graphic depiction of the results of laboratory experiments designed to test the solvents indicated in a solvent-assisted gravity drainage process under Burnt Lake reservoir conditions. The results for each solvent are expressed in terms of the rate of oil production (grams/hour versus time (hours)), and the cumulative oil produced (grams) versus time (hours). The solvents were.
Figure 8B:
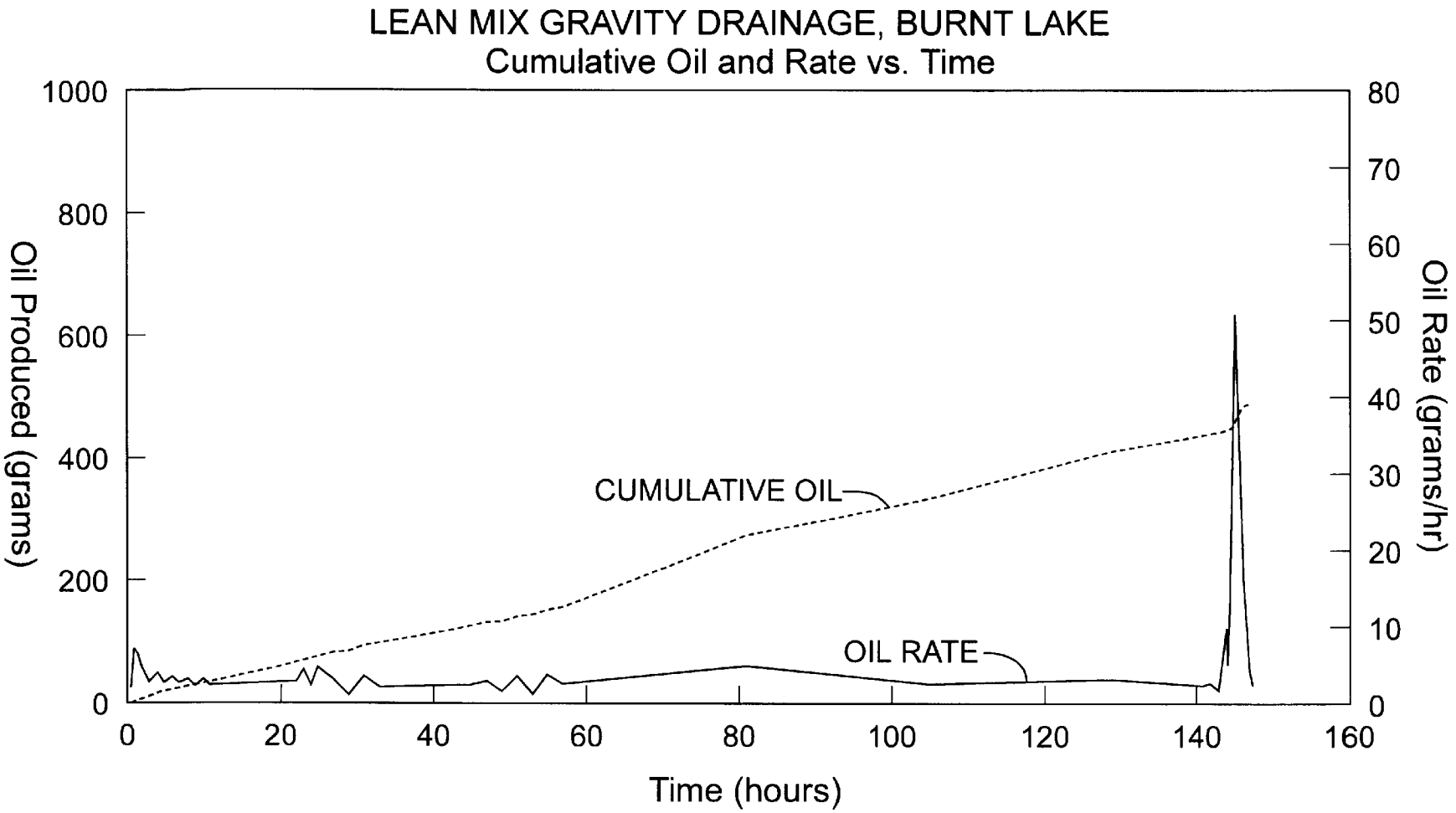
Figure 8C:
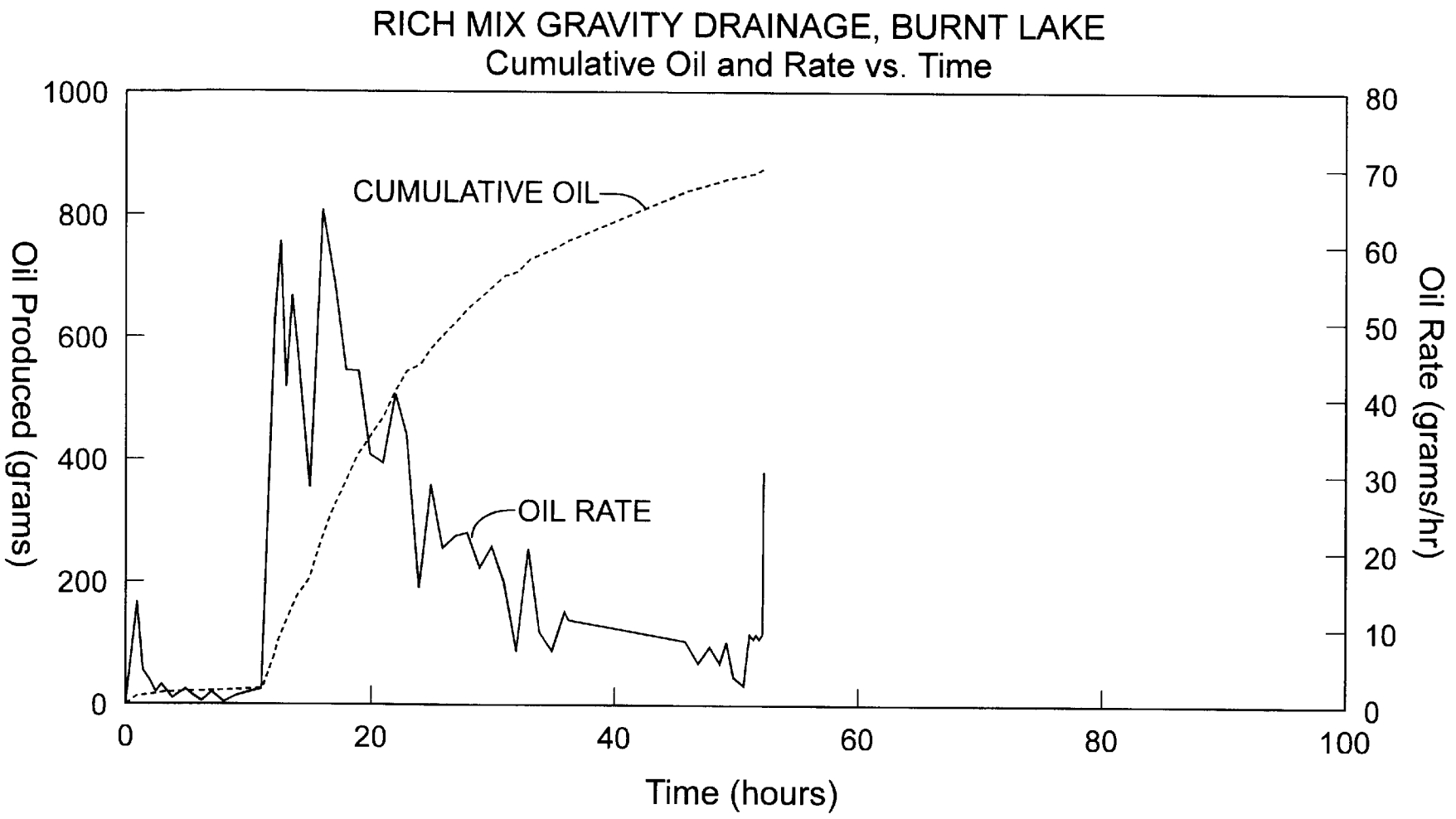
Figure 8D:
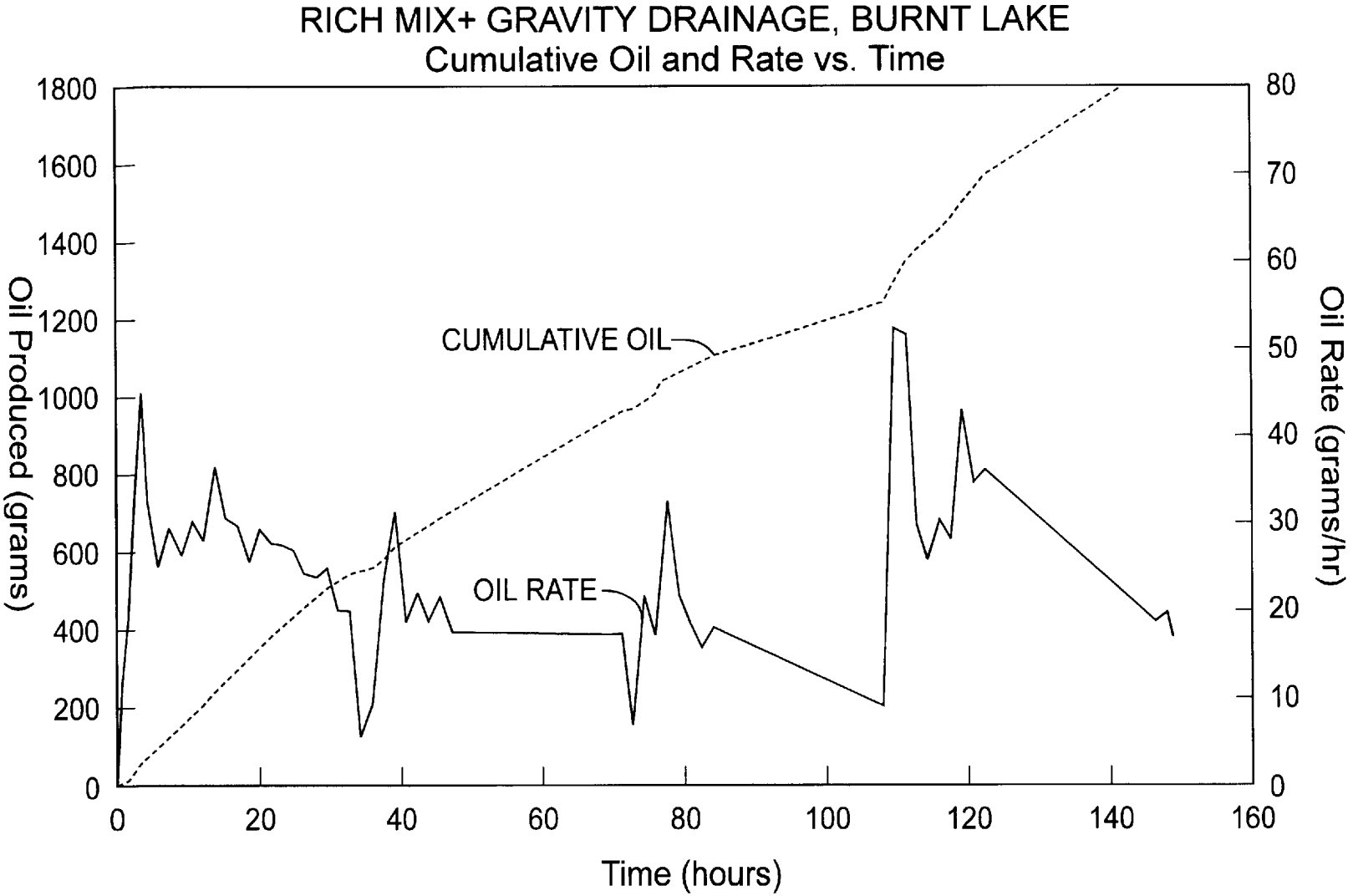

"Rich mix +". The "rich mix+" solvent composition of methane, ethane and propane (12%:70%:12% on a molar basis) also existed in two phases at reservoir condition, as can be seen from the phase diagram in FIG. 7, and was predicted to be 14% liquid at reservoir conditions. This solvent was predicted to produce the same viscosity reduction as the "rich mix" (see FIG. 6). The choice of ethane, rather than propane as the predominant component was based on its lower cost.

Results

The data obtained with each of the 4 solvents is shown graphically in FIG. 8, Panels A–D, in terms of both the rate of oil production, and the cumulative oil production over the course of the experiments. Oil production was achieved with each of the 4 solvents. Production was significantly higher with the solvents which formed a 2 phase system at reservoir conditions, the "rich mix" (Panel C) and "rich mix +" (Panel D). These production data were scaled up to field time, using the principles of scaling outlined above. The resulting projected field recoveries for the 4 solvents, in terms of % OOIP, are shown graphically in FIG. 9. The differences between the single phase and 2 phase solvents were profound. The "rich mix" C1–C3 produced an excellent projected recovery of oil (72% OOIP in 15 years). Production using the "rich mix +" C1–C2–C3 was slightly less rapid (48% OOIP in 15 years). The recoveries using the single phase (gaseous) solvents, $CO_2$ (17% OOIP in 15 years) and "lean mix" C1–C3 (12% OOIP in 15 years), were significantly lower.

We attribute the extraordinary efficiency of the "rich mix" to the high proportion of liquid propane in the mixture, which acted as a very aggressive solvent. The "rich mix+" solvent was predominantly in the vapor state, which was not as active. Although the "rich mix" produced oil more efficiently than the "rich mix +", the projected cost for materials was about \$145/$m^3$ versus \$78/$m^3$. From an economic perspective, therefore, the "rich mix +" may be a more practical choice of solvent.

In addition to the dual horizontal well experiments simulating Burnt Lake reservoir conditions reported herein, we have conducted similar tests simulating Lloydminster reservoir conditions, using solvent mixtures designed to be near their dew point under those reservoir conditions. The solvents were also tested in the context of a variety of well configurations under Lloydminster reservoir conditions, and found to be effective. These include:

a single well cyclic process, in which a single horizontal well is used alternately for solvent injection and oil production;

a single well process in which a single horizontal well is used simultaneously for solvent injection and oil production;

a post-primary single well cyclic process, where oil is recovered from a reservoir which has been depleted to a low pressure; and a post-primary process utilizing vertical wells, with "wormholes" (which are believed to be formed under pressure in some reservoirs) extending out horizontally from the vertical wells.

Production of mobilized oil during the post-primary processes noted above is believed to occur by regeneration of solution gas drive and foamy oil behaviour, rather than by gravity drainage.

The invention, demonstrated herein in the context of dual horizontal wells and gravity drainage, is not limited to those conditions, but is equally applicable to any primary or post-primary heavy oil deposit as a means of mobilization and production, whether by gravity drainage, or other means.

The embodiments ofthe invention in which an exclusive property or privilege is claimed are defined as follows:

1. A solvent-assisted gravity drainage process for recovering heavy oil from a reservoir penetrated by well means for injecting solvent into the reservoir and producing mobilized oil from the reservoir, comprising:

mixing at least two solvents, each soluble in oil, at ground surface to form a substantially gaseous solvent mixture;

said solvent mixture having a dew point that substantially corresponds with reservoir pressure and temperature, said solvent mixture further having a vapor/liquid envelope which encompasses the reservoir conditions, so that at the reservoir conditions the solvent mixture is present in both liquid and vapor forms, but predominantly as vapor;

injecting the substantially gaseous solvent mixture into the reservoir to mobilize contained oil; and recovering said mobilized oil.

2. The process of claim 1, wherein the solvent mixture is injected into an upper injection well and the mobilized oil is collected by gravity into a lower production well.

3. A process for recovering heavy oil from a reservoir comprising the steps of:

mixing at least two solvents at ground surface to form a gaseous solvent mixture;

injecting said gaseous solvent mixture into the reservoir to produce a mobilized oil, wherein at least a portion of said gaseous solvent mixture forms a liquid in the reservoir; and recovering said mobilized oil.

4. The process of claim 3, wherein said liquid comprises at least about 15 mole percent.

5. The process of claim 3, wherein proportions of each of the solvents are selected based on gas-liquid composition of said gaseous solvent mixture at a pressure and temperature of the reservoir.

6. A process for recovering heavy oil from a reservoir comprising the steps of:

determining the temperature and pressure of a reservoir;

selecting a solvent mixture comprising at least two solvents based on the temperature and pressure of the reservoir, wherein a dew point of said solvent mixture corresponds with the temperature and pressure of the reservoir, and wherein said solvent mixture is substantially a gas at ground surface;

injecting said solvent mixture to produce a mobilized oil; and recovering said mobilized oil.

7. The process of claim 6, wherein the proportion of each solvent is selected based on the Peng-Robinson equation of state.

8. The process of claim 6, wherein at least a portion of said gas forms a liquid in the reservoir.

* * * * *